US005653437A

United States Patent [19]

Inoue et al.

[11] Patent Number: 5,653,437

[45] Date of Patent: Aug. 5, 1997

[54] SHEET DISCHARGER

[75] Inventors: Yoshio Inoue; Atsuyuki Kitamura; Koichi Sato, all of Kanagawa, Japan

[73] Assignee: Fuji Xerox Co., Ltd., Tokyo, Japan

[21] Appl. No.: 477,595

[22] Filed: Jun. 7, 1995

[30] Foreign Application Priority Data

Jun. 14, 1994 [JP] Japan ..... 6-132290

[51] Int. Cl.[6] ..... B65H 29/40

[52] U.S. Cl. ..... 271/178; 271/212; 271/220

[58] Field of Search ..... 271/178, 177, 271/212, 220, 207

[56] References Cited

U.S. PATENT DOCUMENTS

| | | | |
|---|---|---|---|
| 3,704,793 | 12/1972 | Nicol et al. | 271/178 |
| 4,222,557 | 9/1980 | Wu | 271/178 X |
| 4,268,021 | 5/1981 | Rutishauser et al. | 271/178 X |
| 4,447,167 | 5/1984 | Euteneuer et al. | 271/177 X |
| 5,078,383 | 1/1992 | Shiina et al. | 271/212 |
| 5,092,576 | 3/1992 | Takahashi et al. | 271/212 X |

FOREIGN PATENT DOCUMENTS

| | | | |
|---|---|---|---|
| 61-36523 | 10/1986 | Japan . | |
| 62-194261 | 8/1987 | Japan . | |
| 63-26661 | 2/1988 | Japan . | |
| 63-185770 | 8/1988 | Japan . | |
| 28191 | of 1911 | United Kingdom | 271/178 |

*Primary Examiner*—David H. Bollinger
*Attorney, Agent, or Firm*—Finnegan, Henderson, Farabow, Garrett & Dunner, L.L.P.

[57] ABSTRACT

In a sheet discharger with a simple structure, the subsequently discharged sheet can be stored under such a condition that this subsequently discharged sheet is overlapped on the rear surface of the previously discharged sheets. The sheet discharger includes a vertical type sheet discharge tray inclined backwardly along an upper direction; an discharge roller apparatus having a front side discharge roller and a rear side discharge roller, which are arranged at a lower end portion of the vertical type sheet discharge tray. The vertical type sheet discharging tray includes a rear surface supporting member for supporting a rear surface of an discharged sheet, a bottom member for supporting a lower end of the discharged sheet, and a front surface supporting member for defining a forward position of the lower end of the discharged sheet. The bottom member is arranged in front of said discharge roller apparatus, further includes sheet rear end position control means for positioning a rear end of a sheet discharged to the vertical type sheet discharge tray over said bottom member.

9 Claims, 13 Drawing Sheets

SHEET DISCHARGER

BACKGROUND OF THE INVENTION a) Field of the Invention

The present invention relates to a sheet discharger for an image recording apparatus such as an Xerographic copying machine and a printer, and in particular, to a sheet discharger capable of discharging printed sheets on which images have been recorded while sorting these sheets in a page order. The present invention is particularly applicable to a sheet discharger employing a vertically arranged sheet discharge tray of a type that is arranged obliquely backward with respect to an upper, vertical direction, but may also be used with a commonly known sheet tray that is arranged obliquely upward with respect to a sheet discharging direction.

b) Description of Related Art

In case a plurality of pages are printed out from an image recording apparatus such as a low cost printer, it would be appreciated in view of user's comfort that the printed sheets of the plural pages are discharged while being sorted in a page order.

In contrast, a commonly known sheet discharger discharges the printed sheets with the printed surfaces thereof being oriented at the upper side, so that a succeeding printed sheet is discharged onto the printed surface of the preceding printed sheet, and thus the printed sheets are set in the reversed order. That is to say, the sheet discharger of this type suffers from a problem in that a user is required to perform an additional workload sorting the printed sheets in the page order after completion of printing.

Various attempts have been proposed in the art to solve the above-mentioned problem.

The first one is directed to a technique with the use of a large-capacity memory, wherein all of data read from the original image or print data thereof are first stored in the large-capacity memory, and then the printing operation is carried out from the final page. According to this technique, the pages of the sheets are sorted when the printing operation is completed, and further since the printed surfaces of these pages are directed upward, the printing conditions of these printed sheets can be immediately confirmed. Thus, very good operability can be achieved. However, since this technique requires a large-capacity memory, there arises another problem the cost would be considerably increased.

The second technique is to discharge a sheet after the sheet is inverted. Accordance to this technique, the printing operation is sequentially carried out from the first page of the sheets, and each sheet is discharged to the discharge tray to face downwardly. That is to say, the preceding, first page is discharged with its print surface oriented downwardly, and the succeeding, second page is discharged onto the reverse side of the first page with its printed surface oriented downwardly. Therefore, the copy or print sheets can be sorted in the desired page order at the same time when the copy sheets are discharged to the discharge tray. However, this conventional method necessarily requires such extra operations that the printed sheets are once turned over. Also, in accordance with this conventional method, the printed surface cannot be completely observed unless the sheets must be turned over. In general, users intend to confirm, due to their satisfaction, that no fault is made in the printed condition of the first page of the printed sheets. When the printed surface of the sheet is discharged downwardly, as described above, the users would have fear as to whether or not the desirable printed condition could be achieved.

There are other proposals, namely as disclosed in Japanese U.M. publication No. 61-36523, Japanese Laid-open U.M. application No. 63-26661, and Japanese Laid-open Patent Application No. 63-185770.

In these conventional sheet discharging methods, the second page and subsequent pages of the sheets are inserted into the lower side of the previously discharged sheet. Since the subsequent sheets are inserted while the weights of the sheets previously discharged are influenced to these subsequent sheets, it is very difficult in these conventional sheet discharging methods to discharge the second page and subsequent pages of the sheets into the tray.

Any of the above-described prior art is directed to such a method for discharging the sheets into the discharge tray which has not so large inclinations with respect to the horizontal line (will be referred to a "horizontal (transverse) type sheet discharge tray") in such a manner that these sheets are overlapped with each other.

In contrast to the image recording apparatus with employment of the horizontal type sheet discharge tray, there is another image recording apparatus with using a vertical (longitudinal) type sheet discharge tray which is inclined backwardly along the Upper direction. When such a vertical type discharge tray is employed, the vertical (longitudinal) type paper supply tray is normally employed. Since such a vertical type tray is used, it is possible to reduce an installation area required to install the image recording apparatus.

The above-explained conventional vertical type sheet discharge tray is arranged above the discharge roller apparatus constructed of the front side discharge roller and the rear side discharge roller. This vertical type sheet discharge tray has the rear surface supporting member for supporting the rear surface of the discharged sheet and the bottom member for supporting the lower end (edge) of the discharged sheet.

The conventional vertical type sheet discharge tray has such a structure that the discharged sheets are rest against the rear surface supporting member whose upper portion is backwardly inclined. Then, after the sheet of the first page has been discharged while the printed surface thereof is directed to the front side, the sheet of the subsequent, second page is stored in such a way that the printed surface of the second page is overlapped with the front printed surface of the first page while being directed to the front side.

As described above, this conventional vertical type sheet discharge tray has such a structure that the subsequent printed sheets are successively overlapped on the front surface of the previously discharged printed sheet. Therefore, both the rear-surface supporting member and the bottom member of the vertical type sheet discharge tray are arranged so that these members are positioned at the rear side of the discharge roller of the discharge roller apparatus installed below.

In this conventional vertical type sheet discharge tray, the second page of the sheet is overlapped on the printed surfaced of the first page, so that the sequence of the overlapped printed sheets is reversed. As a consequence, after the printing operation is completed, the pages of the sheets must be sorted, which may cause such a problem that unnecessary workloads would be given to the users.

As the method for solving this problem of the vertical type sheet discharge tray, it is conceivable that the bottom member of the vertical type sheet discharge tray is arranged at the front side of the discharge roller apparatus, and the front surface supporting member for supporting the front surface of the discharged sheet is provided at the front end of the bottom member. In this case, the front surface supporting member is arranged in such a way that the upper portion thereof is inclined along the forward direction. With employment of such a construction, the first page of the sheet is discharged with the printed surface thereof being directed downwardly over the front surface supporting member, and then the second page of the sheet is discharged in such a manner that the printed surface of this second page is downwardly directed to the rear surface of the first page of the sheet.

Thus, the printed sheets can be stored into the vertical type sheet discharge tray under such a condition that the sequence of the overlapped printed sheets are sorted in the normal order from the first page.

However, in this conventional solution method, no printed surface of the discharged sheets can be observed.

As a consequence, since the users cannot confirm as to whether or not the printing condition of the first page contains faulty, they may fear that the printing operation is carried out under desirable conditions.

SUMMARY OF THE INVENTION

The present invention has been made to solve the above-described problems, and therefore has an object to provide such a sheet discharger with a simple structure, that the subsequently discharged sheet can be discharged at the rear side of the previously discharged sheet under overlapping conditions.

While describing the contents of the present invention in detail, reference numerals are attached to the relevant constructive elements of the preferred embodiments for a better understanding of the present invention. It should be noted that these reference numerals are employed not to limit the technical scope of the present invention.

A sheet discharger (U2) according to the present invention, comprises:

- a vertical type sheet discharge tray (T) inclined backwardly along an upper direction;
- an discharge roller apparatus (37) having a front side discharge roller (38) and a rear side discharge roller (39), which are arranged at a lower end portion of said vertical type sheet discharge tray (T); wherein:
  - said vertical type sheet discharge tray (T) includes a rear surface supporting member (6) for supporting a rear surface of an discharged sheet (S), a bottom member (41) for supporting a lower end of said discharged sheet (S), and a front surface supporting member (42) for defining a forward position of the lower end of the discharged sheet; and
  - said bottom member (41) is arranged in front of said discharge roller apparatus (37); and also
  - sheet rear end position control means (37, 43, 44) for positioning a rear end of a sheet discharged to said vertical type sheet discharge tray (T) over said bottom member (41).

In the sheet discharger (U2) of the invention, the discharge roller apparatus (37) having the front side discharge roller (38) and the rear side discharge roller (39) discharges the sheet (S) to the lower end portion of the vertical type sheet discharge tray (T) backwardly inclined along the upper direction. The rear end of the sheet (S) discharged to the vertical type sheet discharge tray (T) is positioned on the bottom member (41) located in front of the discharge roller apparatus (37) by the sheet rear end position control means (37, 43, 44).

Accordingly, the rear (lower) end of first page of the sheet (S) firstly discharged to the vertical type sheet discharge tray (T) is supported by the bottom member (41) positioned in front of the discharge roller apparatus (37), and the rear surface of this sheet is supported by the rear surface supporting member (6). As a result, the printing condition of the front surface of the first page of the sheet (S) can be readily confirmed.

Next, since the second page of the sheet (S) discharged to the vertical type sheet discharge tray (T) is discharged from the discharge roller apparatus located backwardly from the bottom member 41, this second page is discharged to the rear side of the first page of the sheet (S). This second page of the sheet (S) is stored in such a manner that the second page is overlapped with the rear side of the first page of the sheet (S).

In other words, since the discharged sheets (S) are stored with being sorted in the page order, the page orders of these sheets are no longer sorted.

The sheet discharger (U2) according to the invention is further characterized by employing the following aspects. That is, said sheet rear end position control means is arranged by a means for causing a tip portion of a sheet (S) discharged from said discharge roller apparatus (37) to abut against said front surface supporting member (42), and said front surface supporting member (42) is so arranged as to guide the abutting tip portion of the sheet (S) along an upper direction and a rear direction.

In the sheet discharger (U2) of the above-noted feature, the sheet rear end position control means (37) causes the tip portion of the sheet (S) to abut against the front surface supporting member (42), which is discharged from the discharge roller apparatus (37) to the vertical type sheet discharge tray (T). Since the front surface supporting member (42) guides the tip portion of the sheet (S) along the upper and rear directions, the sheet (S) discharged upwardly from the discharge roller apparatus (37) located behind the front surface supporting member (42) is discharged in such a manner that the rear end of this discharged sheet is curved along the rear direction. The rear end of the discharged sheet under curved condition is separated from the discharge roller apparatus (37), and at the same time, this sheet is moved along the forward direction due to elasticity of the curved (bent) sheet. Then, the rear end (lower edge) of this sheet (S) is positioned on the bottom member (41) in front of the discharge roller apparatus (37).

Preferably, the means for causing the tip portion of the sheet (S) to abut against the front surface is so constructed by arranging the front side discharge roller (38) and the rear side discharge roller (39), which are positioned to direct the tip portion of the discharged sheet (S) to the front surface supporting member (42).

The structure of the front side discharge roller (38) and the rear side discharge roller (39) directs the tip portion of the discharged sheet (S) to the front surface supporting member (42). This structure corresponds to a means for causing the tip portion of the sheet (S) to abut against the front surface supporting member 42, namely, the sheet rear end position control means.

Further, in the sheet discharge apparatus of the present invention, both of the front side discharge roller (38) and the rear side discharge roller (39) are arranged in such a way that the rear side discharge roller (39) is positioned backwardly and upwardly from the front side discharge roller (38). The structure the rear side discharge roller (39) is arranged backwardly and upwardly with respect to the front side discharge roller (38), may direct the tip portion of the discharged sheet (S) to the front surface supporting member (42). This structure corresponds to such a means for causing the tip portion of the sheet (S) to abut against the front supporting member (42), namely the sheet rear end position control means.

The sheet discharger (U2) according to the present invention is further characterized by employing the following aspects. That is, said sheet rear end position control means (43) is arranged by a sheet depressing member (43) which is positioned at a front and lower surface of said rear surface supporting member (6) with being projected along the front direction, and which pushes a sheet discharged from said discharge roller apparatus (37) along the front direction.

In the sheet discharger (U2) having the above-noted featured component, the sheet depressing member (sheet rear end position control means) 43 projected from the front surface and lower portion of the rear surface supporting member (6) along the front direction may push the sheet (S) discharged from the discharge roller apparatus (379 along the forward direction. As a result, the rear end (lower end) of the sheet (S) discharged from the vertical type sheet discharge tray (T) is arranged on the bottom member (41) at the front side of the discharge roller apparatus (37).

The sheet discharger (U2) according to the present invention is further characterized by employing the following aspects. That is, said sheet rear end position control means (44) is arranged by a rear end transport member (44) which is rotated around a shaft of said front side discharge roller (38), and which transports a rear end of the discharged sheet (S) over said bottom member (41).

In the sheet discharger (U2) having the above-noted featured component, the rear end transport member (sheet rear end position control means) 44 rotated around the shaft of the front side discharge roller (38) may transport the rear end of the sheet (S) discharged to the vertical type sheet discharge tray (T) over the forward bottom member (41). As a result, the rear end (lower edge) of the sheet (S) discharged to the vertical type sheet discharge tray (T) is located on the bottom member (41) in front of the discharge roller apparatus (379).

Another sheet discharger (U2) according to the present invention is characterized by comprising:

- a rear surface supporting member (66) for supporting a rear surface of an discharged sheet (S) and whose tip portion is upwardly inclined along a sheet discharge direction;
- an discharge roller apparatus (60) having an upper side discharge roller (61) and a lower side discharge roller (62), which discharge the sheet to said rear surface supporting member (66);
- a sheet rear end supporting portion (63) arranged at an upper side of said upper side discharge roller (61); and
- sheet rear end position control means (67, 68, 69) for causing the rear end of the sheet (S) discharged to said rear end supporting member (66) to abut against said sheet rear end supporting unit (63).

In the sheet discharger (U2) according to the present invention, the discharge roller apparatus (60) having the upper side discharge roller (61) and the lower side discharge roller (62) may discharge the sheet to the rear surface supporting member (66). The rear surface supporting member (66) supports the rear surface of the discharged sheet (S) under such a condition that the tip portion of the sheet (S) is inclined upwardly. As a consequence, the sheet (S) on the rear surface supporting member (66) is transported with being slipped over the rear side of the sheet (S).

The sheet rear end position control means (67, 68, 69) causes the rear edge of the sheet (S) discharged to the rear surface supporting member (66) to abut the sheet rear end supporting portion (63) arranged on the upper side of the upper side discharge roller (61).

As a consequence, the rear end of the sheet (S) discharged to the rear surface supporting member (66) is positioned on the upper side of the upper side discharge roller (61). Thus, the sheet (S) subsequently discharged is discharged to the lower side of the previously discharged sheet (S). As a consequence, since the sheets discharged on the rear surface supporting member (66) are stored with being sorted in the page order, the page order of these discharged sheets need not be again sorted.

BRIEF DESCRIPTION OF THE DRAWINGS

For a better understanding of the present invention, reference is made of the detailed description to be read in conjunction of the accompanying drawings, in which.

DETAILED DESCRIPTION OF THE PREFERRED EMBODIMENTS

Figure 1:
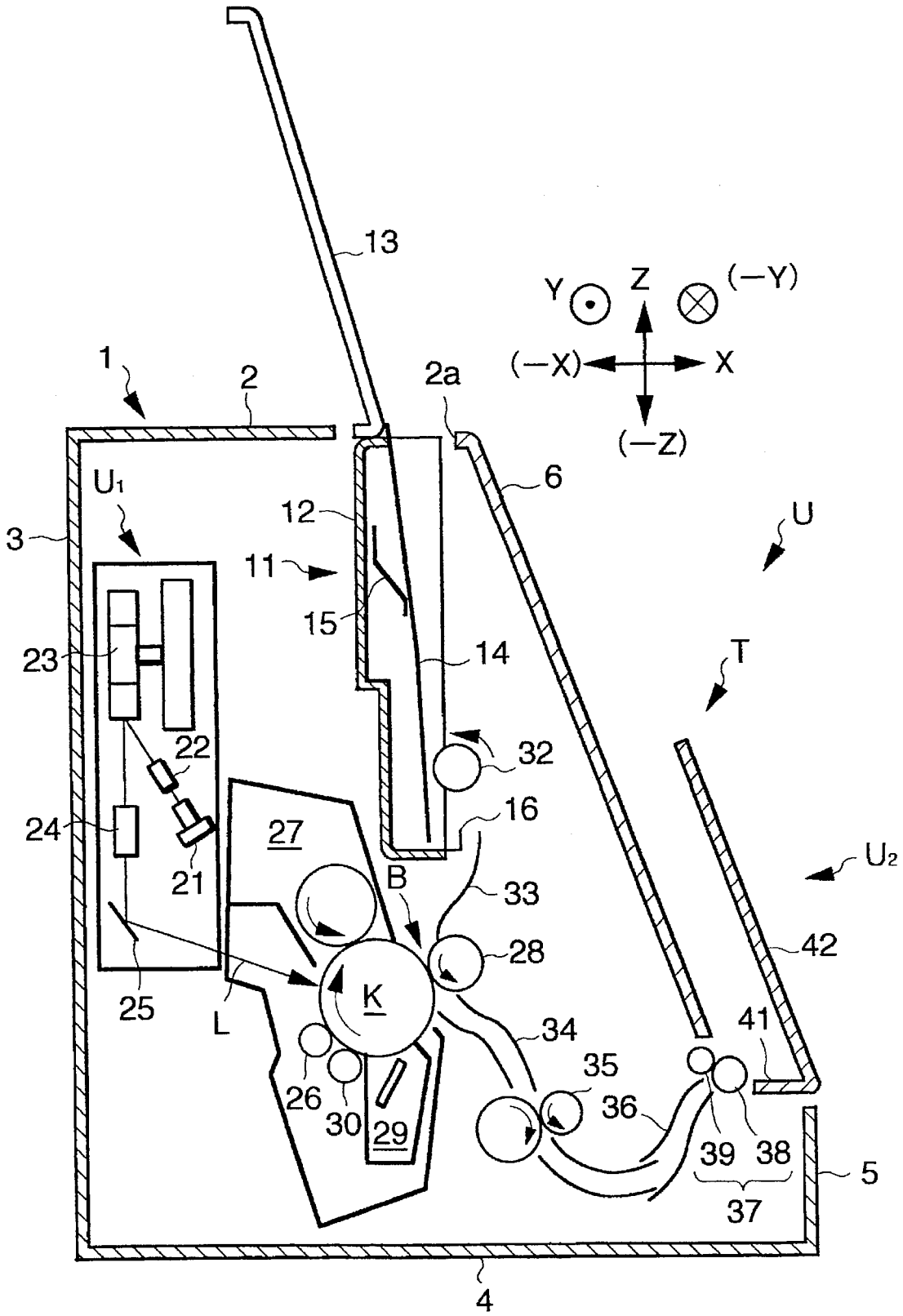
FIG. 1 explanatorily shows a side sectional view of an image recording apparatus into which a sheet discharger according to an embodiment 1 of the present invention has been assembled.

Referring now to the drawings, various embodiments of a sheet discharger according to the present invention will be described. It should be understood that the present invention is not,limited to the below-mentioned embodiments.

For a better and easy understanding of the following explanations, the below-mentioned definitions are made in the specification. The rectangular (orthogonal) coordinate axes, namely X-axis, Y-axis and Z-axis are located along X, Y, Z-arrow directions perpendicular to each other on the drawings, in which the X-arrow direction is a front direction, the Y-arrow direction is a left direction, and the Z-arrow direction is an upper direction. In this case, a direction (namely, -X direction, reverse X-direction) opposite to the X-direction (forward) is backward, another direction (-Y direction, i.e., reverse Y direction) opposite to the Y-direction (left direction) is rightward, and also another direction (-Z direction, namely reverse Z-direction) opposite to the Z-direction (upward) is downward.

Further, both of the forward (X) direction and the backward (-X) direction are jointly referred to a forward/backward direction, or an X-axis direction, both of the leftward (Y) direction and the rightward (-Y) direction are jointly referred to a left/right direction, or a Y-axis direction, and both of the upward (Z) direction and the down (-Z) direction are jointly referred to an upper/lower direction, or a Z-axis direction.

Furthermore, an arrow indicated by "." within a circle implies an arrow directed from a rear side of a drawing to a front side thereof, whereas another arrow indicated by "X" within a circle implies an arrow directed from a front side of a drawing to a rear side thereof.

[EMBODIMENT 1]

Figure 2:
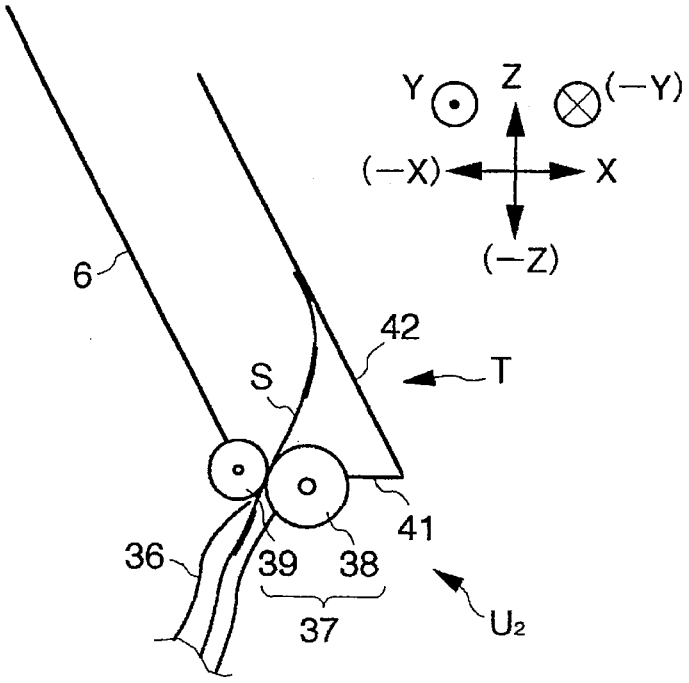
FIG. 2 explanatorily indicates such a condition that a first page of printed sheets is discharged in the sheet discharger of FIG. 1.
Figure 3:
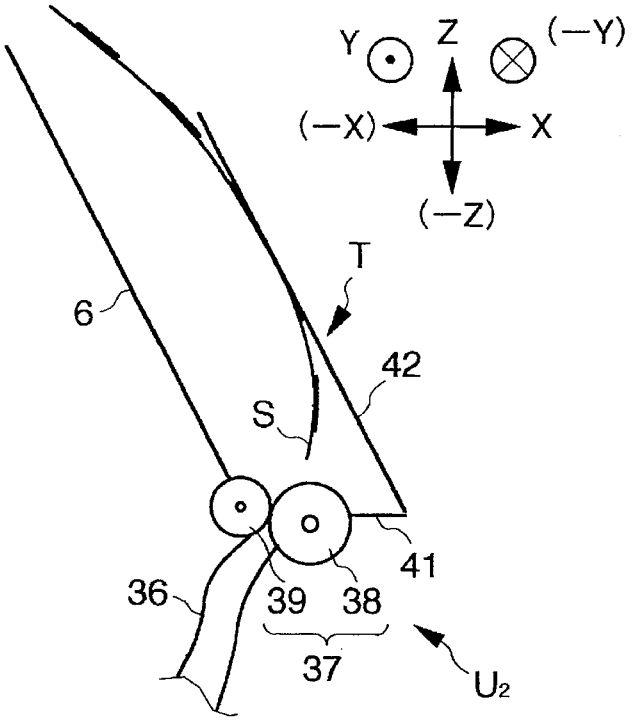
FIG. 3 explanatorily represents another condition subsequent to the previous condition of FIG. 2.
Figure 4:
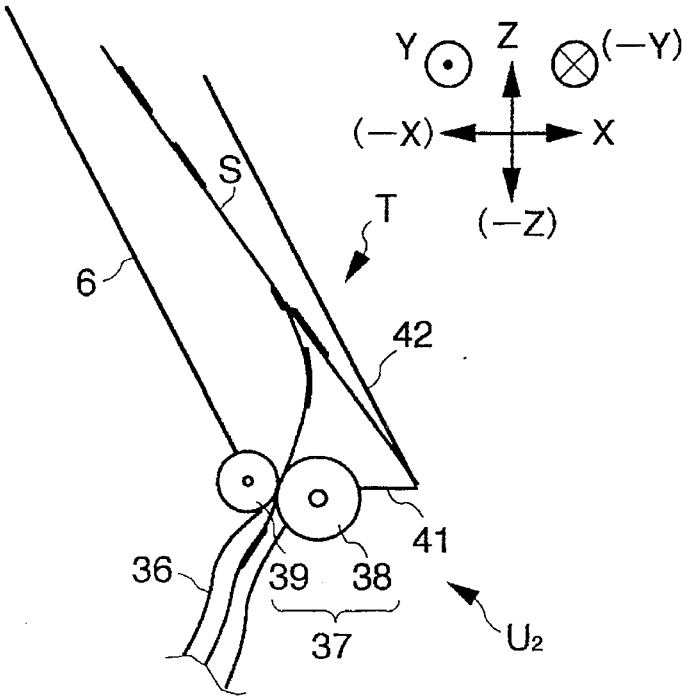
FIG. 4 explanatorily denotes another condition that the discharge operation of the first page of the printed sheets has been accomplished in the embodiment 1 of FIG. 1.
Figure 5:
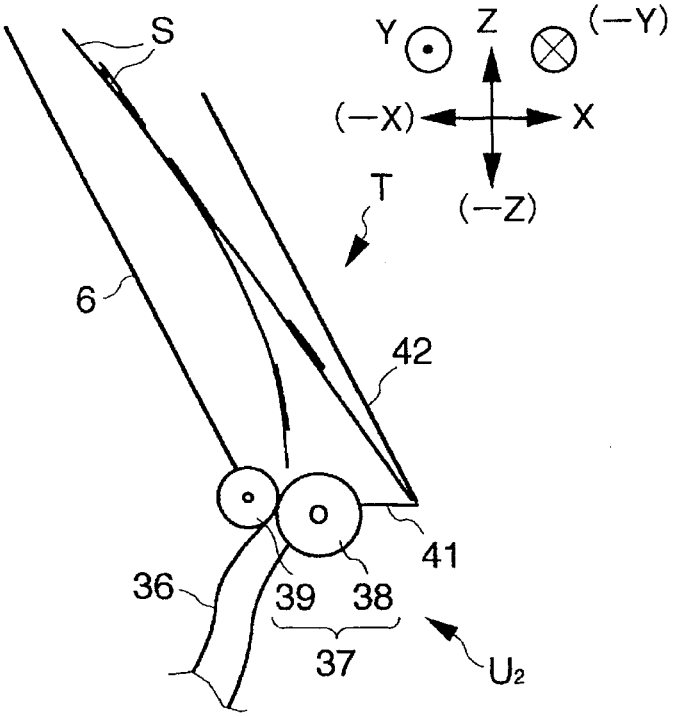
FIG. 5 explanatorily represents another condition that a second page of the printed sheets is discharged in the embodiment 1.

FIG. 1 explanatorily indicates a side sectional view of an image recording apparatus into which a sheet discharging (delivering) apparatus according to an embodiment 1 of the present invention has been assembled. FIG. 2 is an operation explanatory diagram of the sheet discharger according to the embodiment 1, and represents such a condition that a first page of printed sheets is discharged. FIG. 3 is another operation explanatory diagram of the embodiment 1, and shows a condition subsequent to the above condition of FIG. 2. FIG. 3 explanatorily represents another condition subsequent to the previous condition of FIG. 2. FIG. 4 explanatorily denotes another condition that the discharge operation of the first page of the printed sheets has been accomplished in the embodiment 1 of FIG. 1. FIG. 5 explanatorily represents another condition that a second page of the printed sheets is discharged in the embodiment 1.

In FIG. 1, an image recording apparatus U includes a case 1. The case 1 is constructed of an upper wall member 2, a rear wall member 3, a bottom wall member 4, a front wall member 5, and a rear surface supporting member 6.

An opening 2*a* used to mount a paper supply tray thereon is formed at a front edge portion of the upper wall member 2. The paper supply tray 11 is mounted in such a manner that the paper supply tray 11 is inserted from the opening 2*a* into the case 1. The paper supply tray 11 is arranged by a paper supply tray main body 12 at the lower portion, a sheet upper portion supporting member 13 supported by an upper end of this paper supply tray main body 12, and a sheet lower portion depressing plate 14 pivotally supported to the paper supply tray main body 12. The paper supply tray 11 is further constructed of a leaf spring 15 for depressing this sheet lower portion depressing plate 14 along the forward direction (namely, X direction), and pawls 16 provided on the right and left edges of the lower end of the paper supply tray main body 12.

In FIG. 1, an image recording apparatus U includes a laser scanning system U1. This laser scanning system L1 is arranged by a semiconductor laser oscillator 21 functioning as a laser light source, a collimate lens 22 for collecting a laser beam "L" emitted from this semiconductor laser oscillator 21 to collimate the collected laser beam "L", and a polygon mirror 23 for deflecting the laser beam from this collimate lens 22 along the scanning direction. The laser scanning system U1 is further arranged by a convex 24 for focusing/irradiating the deflected laser beam L onto a photosensitive drum (namely, latent image carrier) "K", and a cylindrical mirror 25 for correcting an image inclination of the polygon mirror 23.

The laser scanning system U1 is connected to an image processing apparatus (not shown) for supplying an image information signal to the semiconductor laser oscillator 21.

An electronic charger (charging roller) 26 for charging a surface of the photosensitive drum K is arranged around this photosensitive drum K.

At the peripheral portion of each of the photosensitive drums K, there are provided a developing device 27 for storing toner, a transfer device (transfer roller) 28 for transferring a toner image formed on the photosensitive drum K to a sheet (transfer material), a cleaner 29 for removing the toner remaining on the photosensitive drum K, and a discharging device (discharging roller) 30 for removing the remaining electric charges on the photosensitive drum K in the order of the drum rotation direction from the charger 26.

A paper supply roller 32 functioning as a sheet supplying (delivering) member is provided at a front side of a lower edge portion of the paper supply tray 11. The paper supply roller 32 has such a function to deliver sheets stored in the paper supply tray 11 along the lower direction. A guide 33 is positioned below the paper supply roller 32. The guide 33 has a function to guide a sheet supplied from the paper supply tray 32 to a transfer position (namely, contact portion between photosensitive drum K and transfer device 28) B.

Another guide 34 is provided at the lower stream side of the transfer position B. This guide 34 has a function to guide such a sheet S to which a toner image has been transferred at the above-explained transfer position B to an image fixing roller 35. A further guide 36 is provided at the down stream side of the image fixing roller 35. This guide 36 has such a function to guide the sheet S to which the toner image has been transferred by the fixing roller 35 to an discharging roller apparatus 37.

The discharging roller apparatus 37 is arranged by a front-side discharge roller 38 and a rear-side discharge roller 39 which is located backwardly (-X direction) and upwardly (Z direction) with respect to this front-side discharge roller 38. As described above, one pair of discharge rollers 38 and 39 are arranged in this manner, so that a sheet discharged from the sheet discharge roller apparatus 37 constructed of one pair of discharge rollers 38 and 39 can be directed to the front direction (X direction) as well as the upper direction (Z direction).

At a front side of the discharge roller apparatus 37, there are provided a bottom member 41 and a front surface supporting member 42 which extends from the front edge of the bottom member 41 to the upper and rear directions.

A vertical (longitudinal) type sheet discharge tray T is constructed of the above-described rear surface supporting member 6, bottom member 41 and front surface supporting member 42. It should be noted that any types of members such as plate-shaped members and a plurality of rod-shaped members may be freely employed as the bottom member 41 as long as the bottom member 41 of the vertical type sheet discharge tray T has such a function to support a lower edge of the sheet S discharged to the vertical type sheet discharge tray T from the discharge roller apparatus 37. It should also be noted that any types of members such as plate-shaped members and a plurality of rod-shaped members may be freely used as the front surface supporting member 42 as long as the front surface supporting member 42 defines a surface (sheet tip guiding surface) which serves to guide the front edge of the sheet S discharged from the discharge roller apparatus 37 along the upper and rear directions.

The sheet discharger U2 according to the embodiment 1 is arranged by these elements indicated by the reference numerals 37 to 42.

[OPERATION OF EMBODIMENT 1]

Next, a description will now be made of operations of the sheet discharger with the above-described construction according to an embodiment 1.

The surface of the photosensitive drum K is uniformly charged by the charger 26. An electrostatic latent image is written into this charged surface of the photosensitive drum K by way of the laser scanning system U1. This electrostatic latent image is developed by the developing device 27 as a toner image. The toner image formed on the surface of the photosensitive drum K is transferred to the toner transfer position B in conjunction with the rotation of the photosensitive drum K.

On the other, the sheet S stored in the paper supply tray 11 is transported at a predetermined timing with respect to a writing time of the electrostatic latent image of the laser scanning system U1.

At the toner transfer position B, the toner image is transferred to the sheet S delivered from the paper supply tray 1. This sheet to which the toner image has been transferred is guided by the guide 34 to be transported to the image fixing roller 35. The sheet on which the toner image has been fixed by the fixing roller 35 is discharged from the discharge roller apparatus 37 to the vertical type sheet discharge tray T.

FIG. 2 to FIG. 5 are explanatory diagrams for explaining how the sheets "S" are discharged into the vertical type sheet discharge tray T.

In FIG. 2, a tip portion of a first page of a sheet "S" discharged from the discharge roller apparatus 37 abuts against the rear surface (surface of -X side) of the front surface supporting member 42, and is being moved along this rear surface in the upper and rear directions.

Then, as indicated in FIG. 3, when a rear edge of he first page of the sheet S is discharged from the discharge roller apparatus 37, both the upper and lower edge portions of this sheet S are bent backwardly in a bow shape. Under this condition, when the rear edge of this sheet S is discharged from the discharge roller apparatus 37, the rear edge of the sheet S is flicked in the front direction due to elasticity of this sheet S. Then, a rear edge (namely, lower edge) of this sheet S is supported on the bottom member 41.

In this embodiment 1, a sheet rear end position control means is arranged by the positional structure of the discharge rollers 38 and 39 which are located in such a manner that the sheet S is discharged under condition that both the upper edge portion and the lower edge portion are bent backwardly in the bow shape. Under this condition, since the printed surface of the sheet S is faced to the front direction, the user can confirm the printing condition of this sheet.

FIG. 4 illustratively shows such a condition that a second page of the sheet S is discharged to the vertical type sheet discharge tray T after the first page of the sheet S. A tip portion of the second page of the sheet is being moved along the rear surface (namely, the surface opposite the printed surface) of the first page of the sheet S in the upper direction and the lower direction. Then, similar to the first page of the sheet S, the rear edge (lower end) of the second page of the sheet is bent along the front direction and then supported on the bottom ember 41.

[EMBODIMENT 2]

Figure 6:
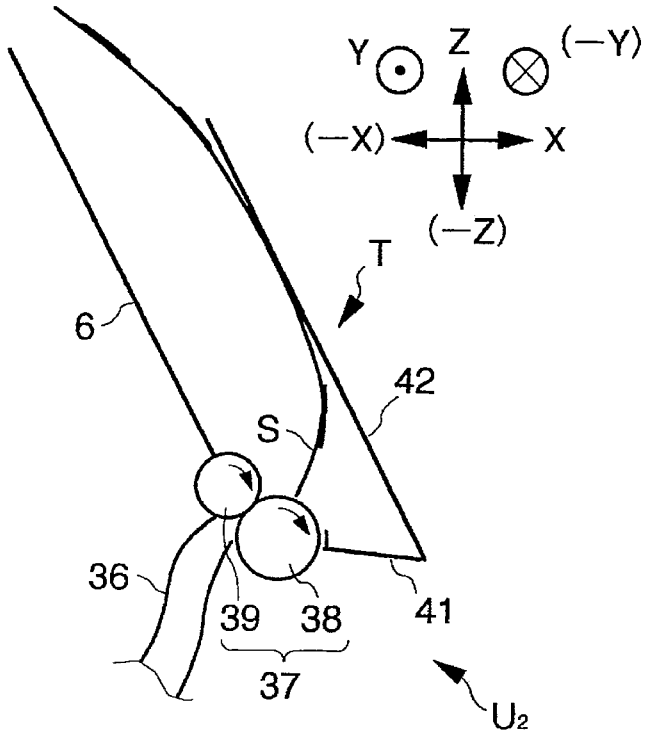
FIG. 6 schematically indicates such a condition that a first page of printed sheets "S" has been discharged in a sheet discharger according to an embodiment 2 of the present invention.
Figure 7:
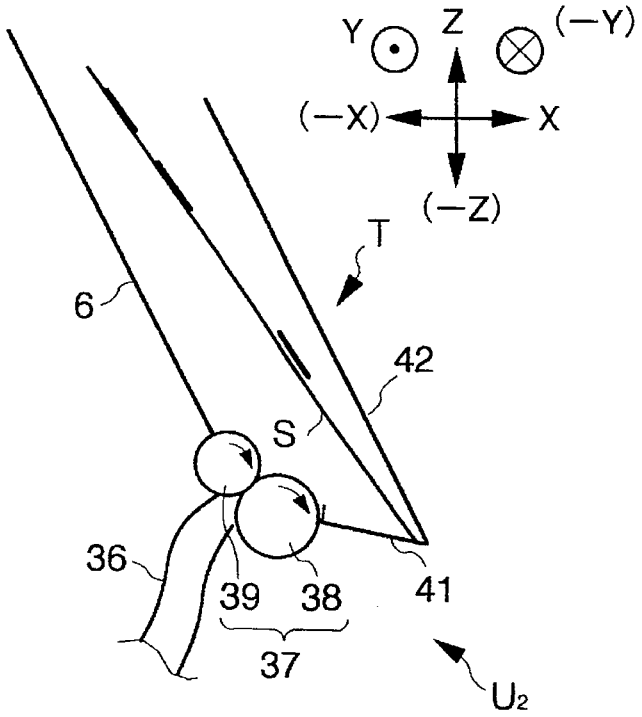
FIG. 7 explanatorily shows another condition that the discharge operation of the first page of the printed sheets has been completed in the embodiment 2 of FIG. 6.

Next, a sheet discharger U2 according to an embodiment 2 of the present invention will now be described. FIG. 6 is an explanatory diagram of this sheet discharger U2, namely represents a condition when the first page of the printed sheet S is discharged. FIG. 7 is another explanatory diagram of this embodiment 2, namely shows a condition that when the first page of the printed sheet has been discharged.

In the following description of this embodiment 2, the same reference numerals are employed as those for denoting the constructive elements corresponding to those of the embodiment 1, and no detailed descriptions thereof are made.

Although this embodiment 2 is different from the above-described embodiment 1 as to the below-mentioned points, other points are similar to those of the embodiment 1.

That is, a rear side discharge roller 39 located in the backward (-X) direction and upward (Z) direction of the front side discharge roller 38 of the discharge roller apparatus 37 is arranged at a position more sharply inclined, as compared with that of the embodiment 1.

Further, the bottom member 41 is downwardly inclined along the forward direction.

[OPERATION OF EMBODIMENT 2]

In case the rear end (lower end) of the discharged sheet S is placed on the front side discharge roller 38 because of relatively low discharge force, the rear end of the discharged sheet S is easily moved onto the bottom member 41 with the aid of the downward gravity in cooperation with the friction force produced when the sheet S is transported on the surface of the rotating front side discharge roller 38.

The rear end (lower end) of the sheet S on the bottom member 41 is moved in the front direction along the bottom member 41 which is inclined forwardly and downwardly. As a consequence, a space is formed at the rear side of the previously discharged sheet S, into which the subsequently discharged sheet S can enter.

[EMBODIMENT 3]

Figure 8:
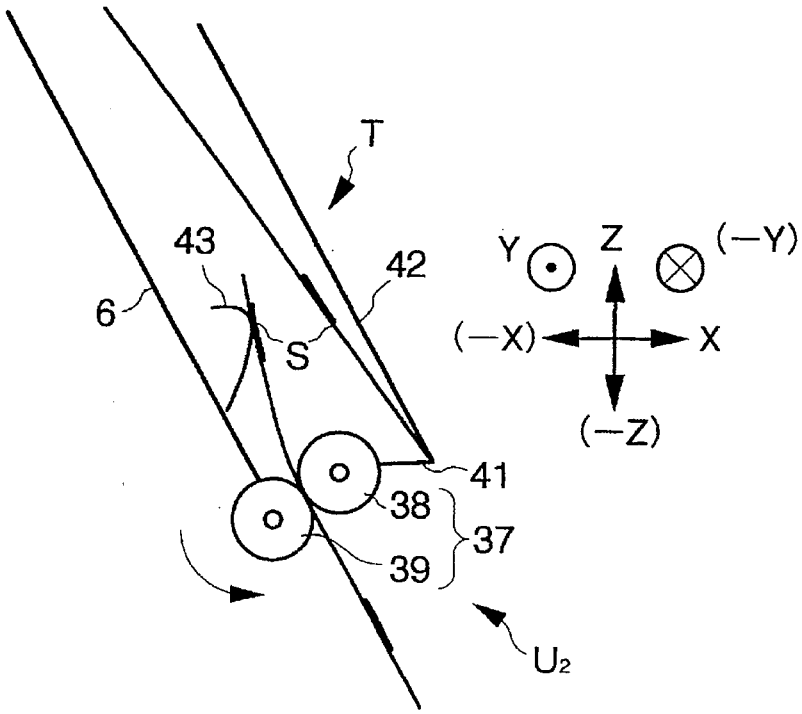
FIG. 8 explanatorily indicates such a condition that a second page of the printed sheets is commenced to be discharged in a sheet discharger according to an embodiment 3 of the present invention.
Figure 9:
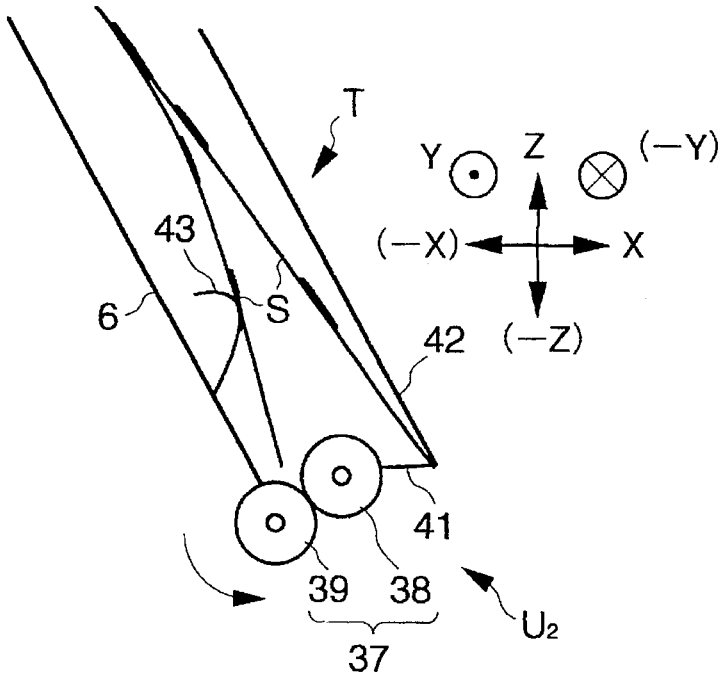
FIG. 9 explanatorily shows another condition when the second page of the printed pages has been discharged in the embodiment 3.

Next, a sheet discharger U2 according to an embodiment 3 of the present invention will now be described with reference to FIG. 8 and FIG. 9. FIG. 8 is an explanatory diagram of this sheet discharger U2, namely represents a condition when the second page of the printed sheet S is started to be discharged. FIG. 9 is another explanatory diagram of this embodiment 3, namely shows a condition that when the second page of the printed sheet has been discharged.

In the following description of this embodiment 3 that the same reference numerals are employed as those for denoting the constructive elements corresponding to those of the embodiment 1, and no detailed descriptions thereof are made.

Although this embodiment 3 is different from the above-described embodiment 1 as to the below-mentioned points, other points are similar to those of the embodiment As the different point, a sheet depressing member (sheet rear end position control means) 43 is arranged at the front lower portion of the rear surface supporting member 6 in such a manner that this sheet depressing member is projected toward the front direction.

The sheet depressing member 43 is constructed of a leaf spring, and has such a function to push the sheet discharged from the sheet discharge roller along the forward direction.

The positions of the front side discharge roller 38 and the rear side discharge roller 39, which constitute the discharge roller apparatus 37, are different from those of the above-explained embodiment 1, and are determined so that the tip portion of the sheet discharged therefrom is directed to the sheet depressing member 43.

[OPERATION OF EMBODIMENT 3]

As shown in FIG. 8, the sheet S discharged from the discharge roller apparatus 37 is discharged toward the sheet depressing member 43 made of the leaf spring. The transport direction of the tip portion of this sheet S is then oriented to the front direction by means of the sheet depressing member 43. Similar to the second page of the sheet S in the embodiment 1, this sheet S is moved upwardly and backwardly along a rear surface (namely, the surface opposite printed surface) of the first page of the sheet S. Then, when the rear end (lower end) of the second page of the sheet is discharged from the discharge roller apparatus 37, this rear end is flicked forwardly due to elasticity of the bent sheet S and then is supported on the bottom member 41.

[EMBODIMENT 4]

Figure 10:
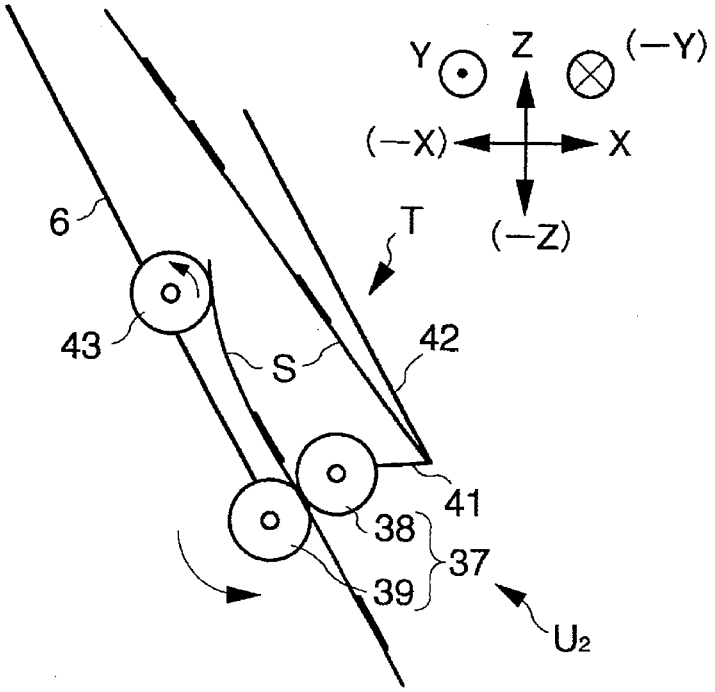
FIG. 10 explanatorily represents such a condition that the discharge operation of the second page of the printed sheets is commenced in a sheet discharger according to an embodiment 4 of the present invention.
Figure 11:
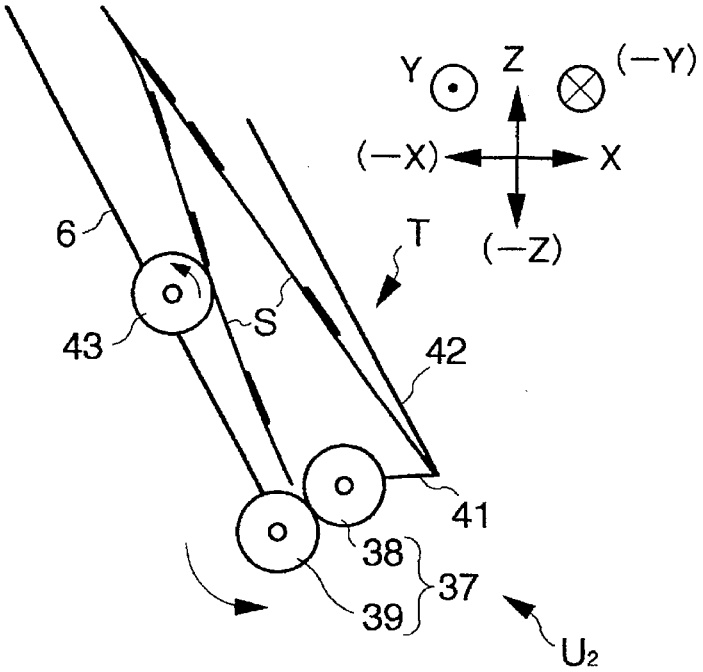
FIG. 11 explanatorily shows such a condition when the second page of the printed sheets is discharged in the embodiment 4.

Next, a sheet discharger U2 according to an embodiment 4 of the present invention will now be described with reference to FIG. 10 and FIG. 11. FIG. 10 is an explanatory diagram of this sheet discharger U2, namely represents a condition when the second page of the printed sheet S is started to be discharged. FIG. 11 is another explanatory diagram of this embodiment 4, namely shows a condition that when the second page of the printed sheet has been discharged.

In the following description of this embodiment 4 that the same reference numerals are employed as those for denoting the constructive elements corresponding to those of the embodiment 3, and no detailed descriptions thereof are made.

Although this embodiment 4 is different from the above-described embodiment 1 as to the below-mentioned points, other points are similar to those of the embodiment 3.

The sheet depressing member (sheet rear end position control means) 43 is constructed of rotatable rollers, and has such a function that a sheet discharged from the above-explained sheet discharge roller is pushed along the front and upper directions.

[OPERATION OF EMBODIMENT 4]

As shown in FIG. 10, the sheet S is discharged from the above-explained discharge roller apparatus 37 toward the sheet depressing member 43 constructed of the rotatable roller. The transportation direction of the tip portion of this sheet is oriented along the front direction by means of the sheet depressing member 43. Similar to the second page of the sheet S in the embodiment 2, this sheet S is moved upwardly and backwardly along a rear surface (namely, the surface opposite the printed surface) of the first page of the sheet S. Then, when the rear end (lower end) of the second page of the sheet is discharged from the discharge roller apparatus 37, this rear end is flicked forwardly due to elasticity of the bent sheet S and then is supported on the bottom member 41.

[EMBODIMENT 5]

Figure 12:
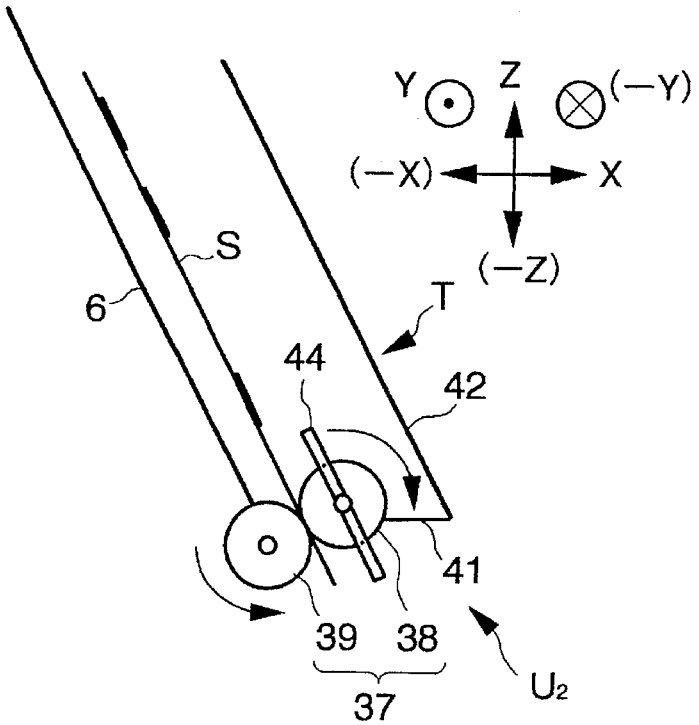
FIG. 12 explanatorily represents such a condition that an discharge operation of a first page of printed sheets is executed in a sheet discharger according to an embodiment 5 of the present invention.
Figure 13:
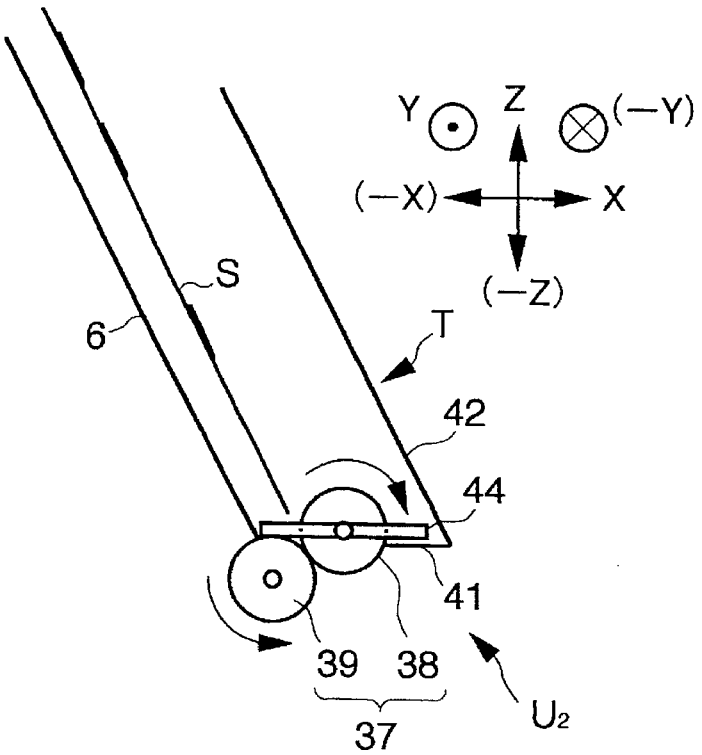
FIG. 13 explanatorily denotes such a condition when a first page of printed sheets has been discharged in the embodiment 5.
Figure 14:
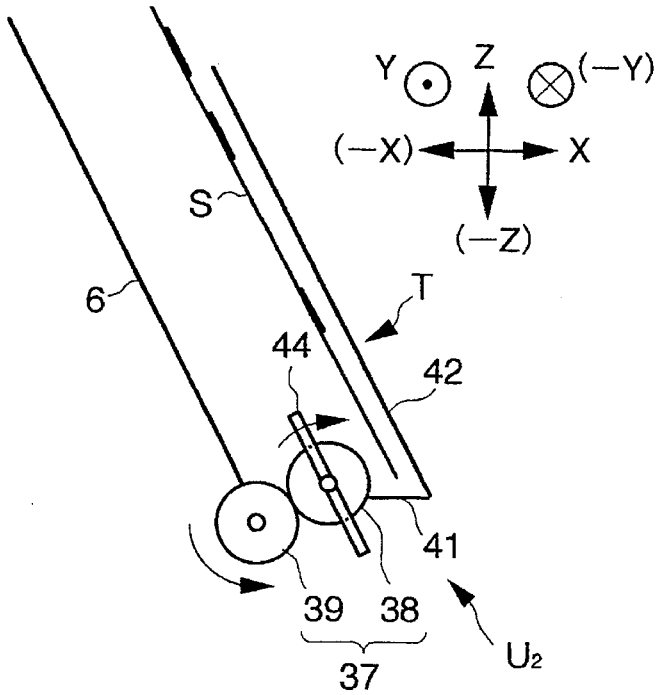
FIG. 14 explanatorily shows another condition that the discharge operation of the first page of the printed sheets is accomplished in the embodiment 5.
Figure 15:
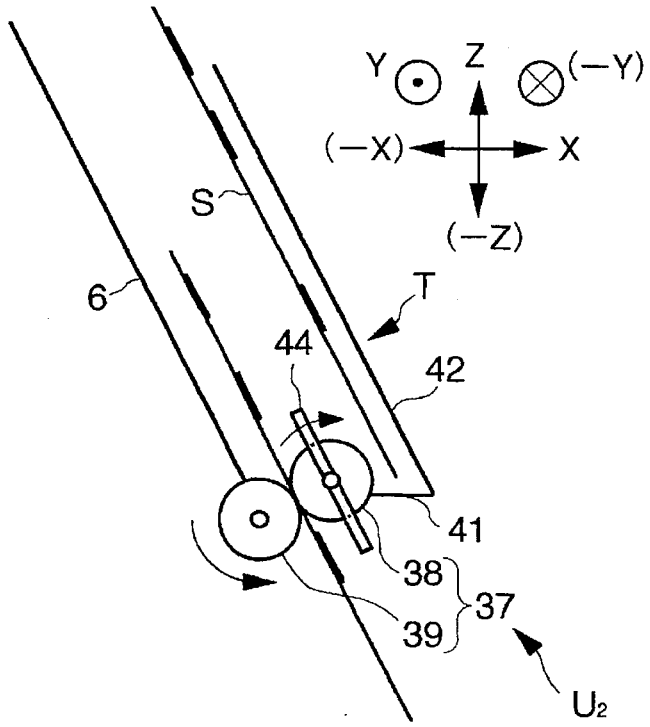
FIG. 15 explanatorily indicates another condition that a second page of the printed sheets is executed in the embodiment 5.
Figure 16:
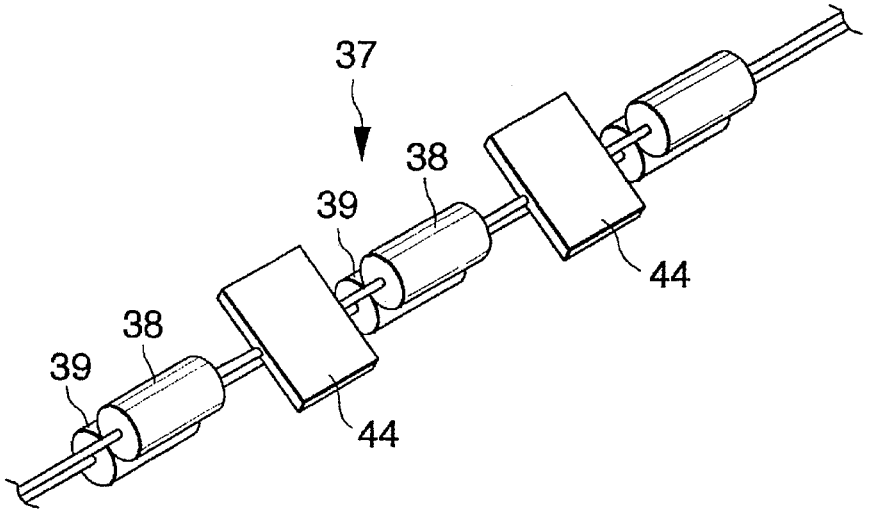
FIG. 16 is a perspective view for showing an discharge roller apparatus 37 of the embodiment 5.

Next, a sheet discharger U2 according to an embodiment 5 of the present invention will now be described with reference to FIG. 12 to FIG. 16. FIG. 12 is an explanatory diagram of this sheet discharger U2, namely represents a condition when the first page of the printed sheet S is discharged. FIG. 13 is another explanatory diagram of this embodiment 5, namely shows a condition that when the first page of the printed sheet has been discharged. FIG. 14 is another explanatory diagram of the embodiment 5, and illustrates such a condition when the discharge of the first page of the printed sheet is completed. FIG. 15 is another explanatory diagram of this embodiment 5, and represents such a condition when the discharge of the second page of the printed sheet is completed. FIG. 16 is a perspective view of the discharge roller apparatus 37 of the embodiment 5.

In the following description of this embodiment 5 that the same reference numerals are employed as those for denoting the constructive elements corresponding to those of the embodiment 3, and no detailed descriptions thereof are made.

Although this embodiment 5 is different from the above-described embodiment 3 as to the below-mentioned points, other points are similar to those of the embodiment 3.

In this embodiment 5, the sheet depressing member 43 on the rear supporting member 6 is omitted. Instead of this sheet depressing member 43, a sheet-shaped rear end transport member (sheet rear end position control means) 44 is fixed to a rotation shaft of a front-side discharge roller 38 constituting the discharge roller apparatus 37. The sheet-shape rear end transport member 44 is made of such a material as chloroprene sponge and having a thickness of approximately 2 mm.

[OPERATION OF EMBODIMENT 5]

In FIG. 12, the first page of the sheet S discharged from the discharge roller apparatus 37 is discharged along the rear surface supporting member 6 of the vertical type sheet discharge tray T. Also, the rear end transport member 44 is rotated in conjunction with the rotation of the discharge roller apparatus 37. At this time, although the rear end transport member 44 is made in contact with the surface of the sheet S, this rear end transport member 44 is bent which does not give any damages to the sheet S, because this transport member 44 is soft.

In FIG. 13, when the first page of the sheet S is discharged to the vertical type sheet discharge tray T, the rear end transport member 44 causes the lower end of the sheet S to be transported along the forward direction. As a consequence, as illustrated in FIG. 14, the lower end of the discharged sheet S is supported by the bottom member 41. When both the front side discharge roller 38 and the rear side discharge roller 39, which constitute the discharge roller apparatus 37, are arranged in a similar manner to the embodiment 1 that the tip portion of the discharged sheet S is discharged toward the supporting member 42, the lower end of the sheet S can be more firmly transported over the upper surface of the bottom member 41.

In FIG. 15, the second page of the sheet S is discharged to the vertical type sheet discharge tray T. Similar to the above-described first page of the sheet S, the lower end of this second page of the sheet S is supported on the upper surface of the bottom member 41.

[EMBODIMENT 6]

Figure 17:
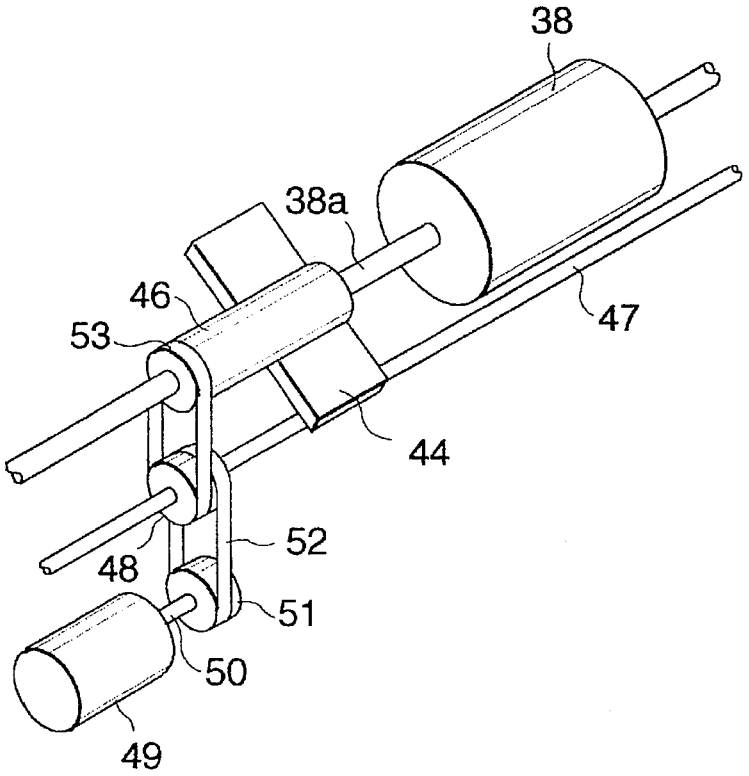
FIG. 17 is an explanatorily diagram for showing a sheet discharger according to an embodiment 6 of the present invention.

Next, a sheet discharger U2 according to an embodiment 6 of the present invention will now be described with reference to FIG. 17. FIG. 17 is an explanatory diagram of this sheet discharger U2, namely schematically shows a structure that the rear end transport member 44 is rotatably driven.

In the following description of this embodiment 6 that the same reference numerals are employed as those for denoting the constructive elements corresponding to those of the embodiment 5, and no detailed descriptions thereof are made.

Although this embodiment 6 is different from the above-described embodiment 5 as to the below-mentioned points, other points are similar to those of the embodiment 5.

In the above-described embodiment 5, the rear end transport member (sheet rear end position control means) 44 has been fixed to the shaft of the front side discharge roller 38 to be integrally rotated with the front side discharge roller. To the contrary, in this embodiment 6, the rear end transport member 44 is rotated by 1 turn every time the sheet S is discharged to the vertical type sheet discharge tray T.

In FIG. 17, a rotary sheet supporting roller 46 is rotatably supported on a rotation shaft 38*a* to which the front side roller 38 is fixed. A pulley 48 is fixed on a rotary sheet drive shaft 47 positioned parallel to the rotation shaft 38*a*. A belt 52 is suspended between the pulley 48 and another pulley 51 fixed to a power shaft 50 of a drive motor 49. Another belt 53 is suspended between the pulley 48 and the rotary sheet supporting roller 46. As a consequence, when the drive motor 49 is rotated, the rotary sheet drive shaft 47 is rotated via the belt 52. When this rotary sheet drive shaft 47 is rotated, both the rotary sheet supporting roller 46 and the rear end transport member 44 are rotated via the belt 52.

As a result, when the sheet S is discharged to the vertical type sheet discharging tray T, the rear end transport member 44 is rotated by 1 turn, so that the rear end (lower end) of the sheet S can be firmly over the bottom member 41.

[EMBODIMENT 7]

Next, a sheet discharger U2 according to an embodiment 7 of the present invention will now be described with reference to FIG. 18 to FIG. 21.

Figure 18:
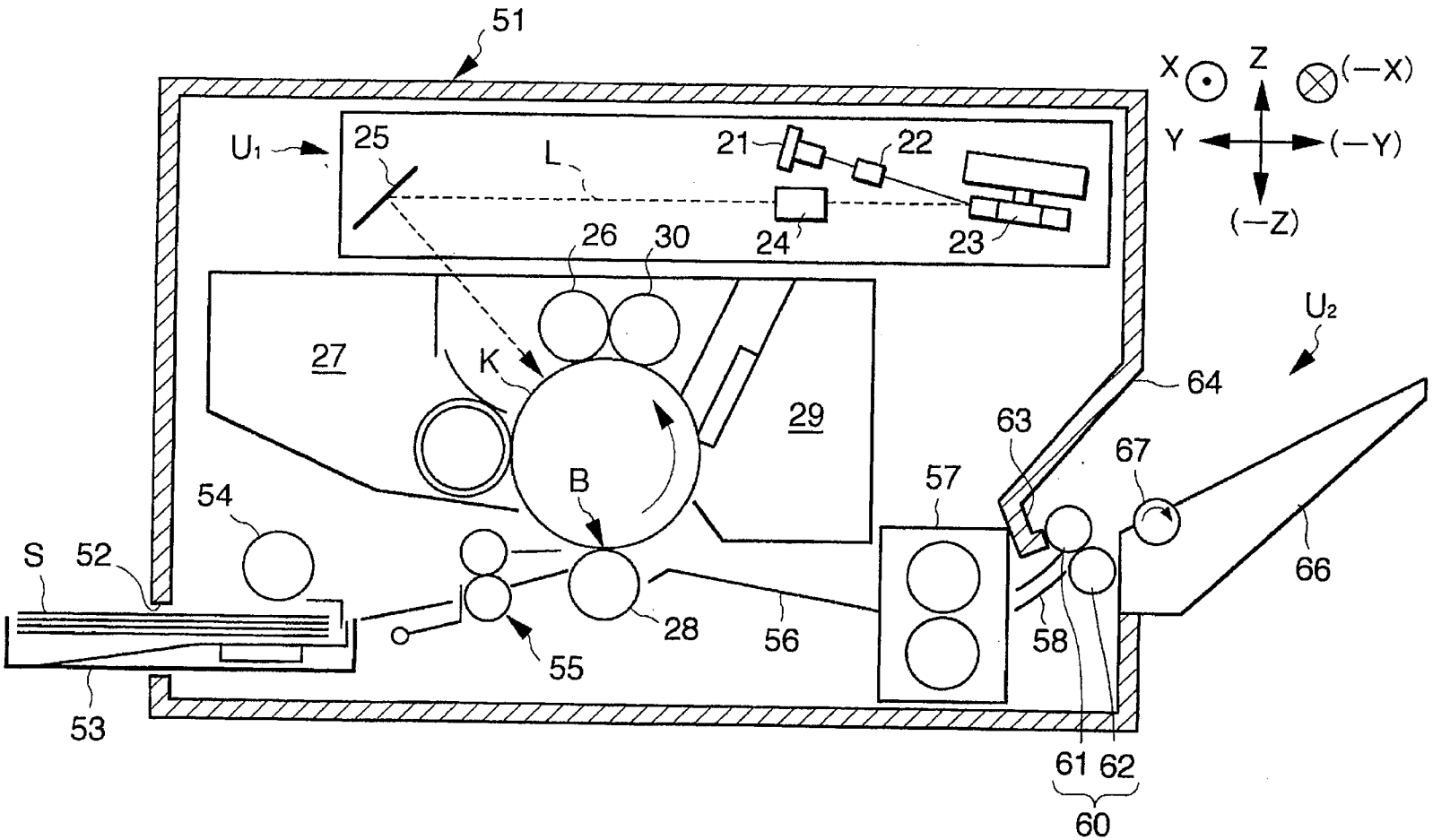
FIG. 18 is a side sectional view for explanatorily indicating an image recording apparatus into which a sheet discharger according to an embodiment 7 of the present invention has been assembled.
Figure 19:
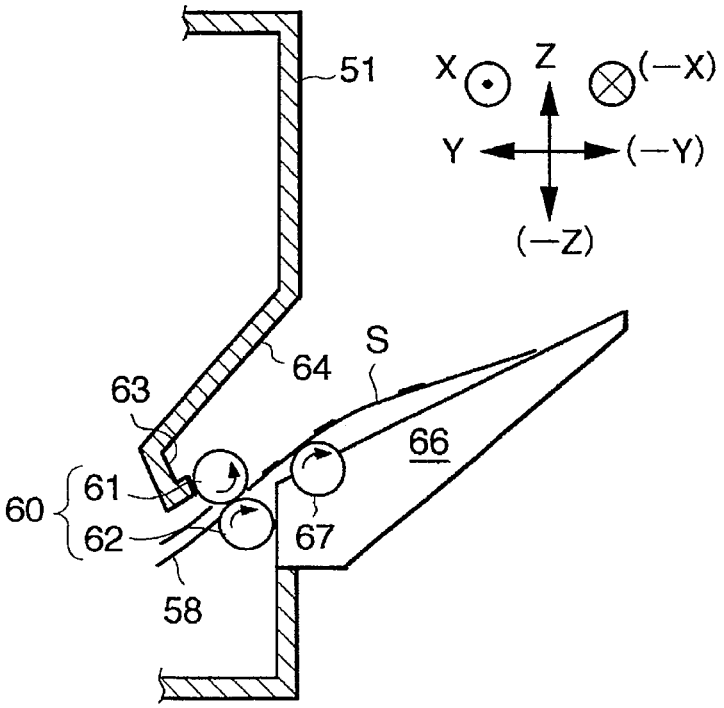
FIG. 19 explanatorily indicates such a condition when a first page of printed sheets is discharged in the embodiment 7.
Figure 20:
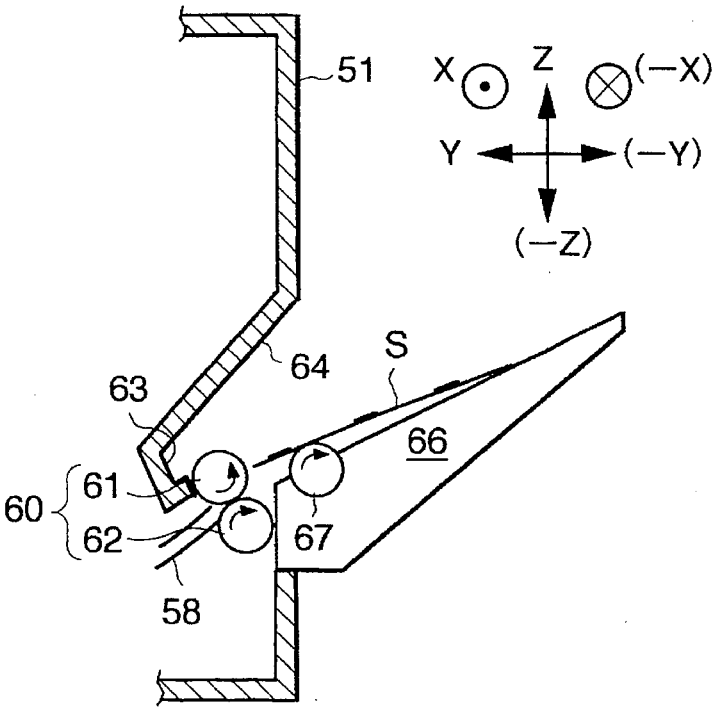
FIG. 20 explanatorily shows another sheet discharging condition subsequent to that of FIG. 19 in the embodiment 7.
Figure 21:
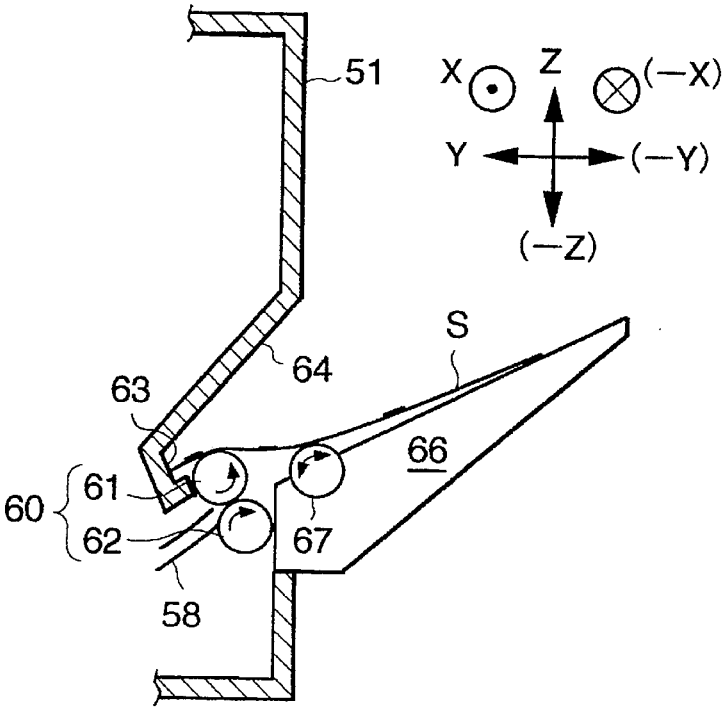
FIG. 21 explanatorily indicates another condition that the discharge operation of the first page of the printed sheets is completed in the embodiment 7.

FIG. 18 is an explanatory diagram for showing a side sectional structure of an image recording apparatus into which the sheet discharger according to the embodiment 7 of the present invention is assembled. FIG. 19 is an explanatory diagram of this sheet discharger U2, namely represents a condition when the first page of the printed sheet is discharged. FIG. 20 is another explanatory diagram of this embodiment 7, namely shows a condition subsequent to the condition of FIG. 19. FIG. 21 is another explanatory diagram of this embodiment 7, and shows such a condition that the first page of the printed sheet has been discharged.

In the following description of this embodiment 7 that the same reference numerals are employed as those for denoting the constructive elements corresponding to those of the embodiment 1, and no detailed descriptions thereof are made.

In FIG. 18, an image recording apparatus U includes a case 51. An opening 52 for mounting a paper supply tray is formed on a left side wall (namely, the wall at the Y-direction side). A paper supply tray 53 is inserted from the opening 52 into this case to be mounted. A sheet S stored in the paper supply tray 53 is transported by a paper transport roller 54 to a register roller 55.

The image recording apparatus U has a laser scanning system U1. Similar to that of the embodiment 1, this laser scanning system U1 is constructed of a semiconductor laser oscillator 21, a collimate lens 22, a polygon mirror 23, a convex lens 24, and a cylindrical mirror 25.

Similar to the above-explained embodiment 1, a charging device 26, a developing device 27, a transfer device 28, a cleaner 29, and a discharging device 30 are arranged around a photosensitive drum K on which an electrostatic latent image is written by operating this laser scanning system U1.

The register roller 55 is operated at a preselected timing in response to the operation of the laser scanning system U1, and has such a function to transport a sheet to the transfer position B.

A guide 56 is provided at a downstream side of this transfer position B. This guide 56 has a function to guide a sheet S to which a toner image has been transferred at the transfer position B to an image fixing roller 57. A guide 58 is provided at a downstream side of the image fixing roller 57, and has such a function for guiding the sheet S to an discharge roller apparatus 60. The toner image has been fixed on this sheet S by the image fixing roller 57.

The discharge roller apparatus 60 is constructed of an upper side discharge roller 61 and a lower side discharge roller 62.

A sheet rear end supporting member 63 extending upwardly is provided at the upper side of the discharge roller apparatus 60. Further, an upper wall member 64 is provided which is extended from an upper end of this sheet rear end supporting member 63 to the upper and right directions.

At an outer side of the discharge roller apparatus 60, a rear surface supporting member 66 is arranged which is upwardly inclined along the outward direction. This rear surface supporting member 66 corresponds to such a member for supporting a rear surface (namely, surface located opposite to image recorded surface) of a sheet discharged from the discharge roller apparatus 60. A sheet depressing member (sheet rear end position control means) 67 is upwardly projected from an inner edge portion (left end portion) of an upper surface of this rear surface supporting member 66. This sheet depressing member 67 is arranged by a rotatable roller constructed of a low friction member, and has such a function to push out upwardly the sheet S discharged from the discharge roller apparatus 60. The respective discharge rollers 61 and 62 of the discharge roller apparatus 60 are arranged in such a manner that the tip portion of the discharged sheet S is directed to the rotatable sheet depressing member 67.

The sheet discharger U2 according to this embodiment 7 is constructed of the constructive elements indicated by reference numerals 60 to 67.

[OPERATION OF EMBODIMENT 7]

Then, operation of the sheet discharger U2 equipped with the above-described Constructions, according to the embodiment 7, will now be described.

The sheet S on which the toner image has been transferred by the image fixing roller 57 is discharged from the discharge roller apparatus 60 to the rear surface supporting member 66.

The tip portion of this discharged sheet S abuts against the rotatable sheet depressing member 67, and then is pushed upwardly.

In FIG. 19, the first page of the sheet S discharged from the discharge roller apparatus 60 is discharged over the rear surface supporting member 66 under such a condition that the first page of the sheet S is upwardly pushed up by the sheet depressing member (sheet rear end control means) 67. Then, as shown in FIG. 19, when the rear end of the first page of the sheet S is discharged from the discharge roller apparatus 60, the rear end portion (lower end portion) of this sheet S is backwardly bent like a bow. When the rear end of this sheet S is discharged from the discharge roller apparatus 60 with such a condition, this rear end of the sheet S is upwardly flicked due to elasticity of the sheet S.

Then, as illustrated in FIG. 20, the rear end namely, lower end of this sheet S is transported in the leftward, lower direction due to influences of gravity and friction force of the upper side roller 61.

Thereafter, as represented in FIG. 21, the discharged sheet S abuts against the sheet rear end supporting member 63 to be supported.

In this embodiment 7, the sheet rear end position control means is constructed by such a sheet depressing member 67 arranged in such a manner that the sheet S is discharged under conditions that the lower end portion of this sheet S is downwardly bent like a bow.

Since the printed surface of the sheet S discharged under such a condition is faced to the upper direction, the user can confirm the printing condition of this sheet.

A second page and the subsequent pages of the sheet S are discharged in a similar manner.

[EMBODIMENT 8]

Figure 22:
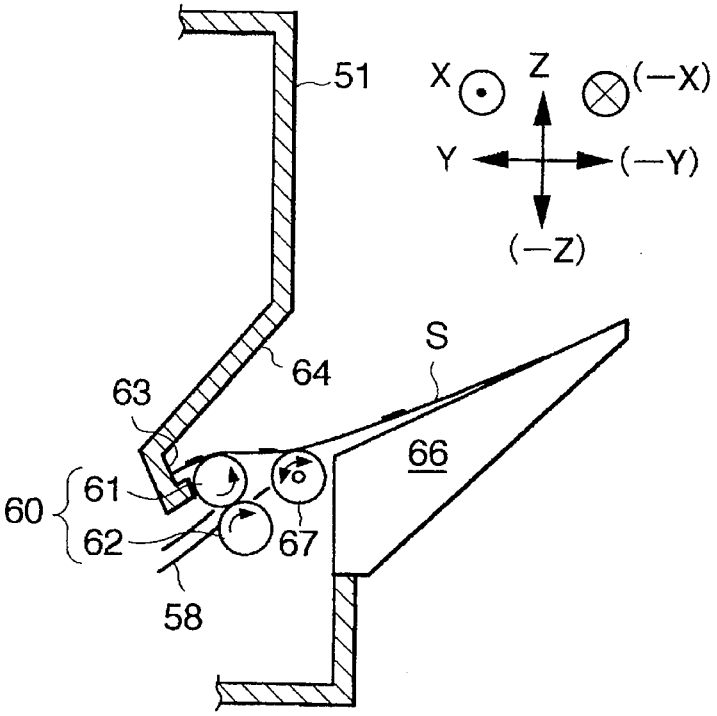
FIG. 22 explanatorily shows a condition that a first page of printed sheets has been discharged in a sheet discharger according to an embodiment 8 of the present invention.

A sheet discharger U2 according to an embodiment 8 of the present invention will now be explained with reference to FIG. 22. FIG. 22 is an explanatory diagram of this embodiment 8.

It should be understood in the following description of this embodiment 8 that the same reference numerals are employed as those for denoting the constructive elements corresponding to those of the embodiment 7, and no detailed descriptions thereof are made.

Although this embodiment 8 is different from the above-described embodiment 7 as to the below-mentioned points, other points are similar to those of the embodiment 7.

In the previous embodiment 7, the sheet depressing member 67 is constructed of the freely rotatable roller. 0n the contrary, in this embodiment 8, the sheet depressing member 67 is rotatably driven by a drive means (not shown in detail) along the normal and reverse directions.

The sheet depressing means (sheet rear end position control means) 67 is arranged within the case 51.

[OPERATION OF EMBODIMENT 8]

Similar to the embodiment 7, the rear end (lower end) of the sheet S discharged on the rear surface supporting member 66 abuts against the sheet rear end supporting member 63 to be supported in this embodiment 8. However, the sheet depressing member 67 is rotatably driven in such a direction as to discharge the sheet S until the sheet S is discharged from the discharge roller apparatus 60, whereas this sheet depressing member 67 is rotatably driven along a direction opposite to the above-described direction after the sheet S has been discharged, namely the direction along which the sheet S is transported toward the sheet rear end supporting member 63.

Since the sheet depressing member 67 is driven in such a manner, even when a total number of sheets stacked on the rear surface supporting member 66 is increased, it is possible to discharge a new sheet under the stacked sheets surely.

[EMBODIMENT 9]

Figure 23:
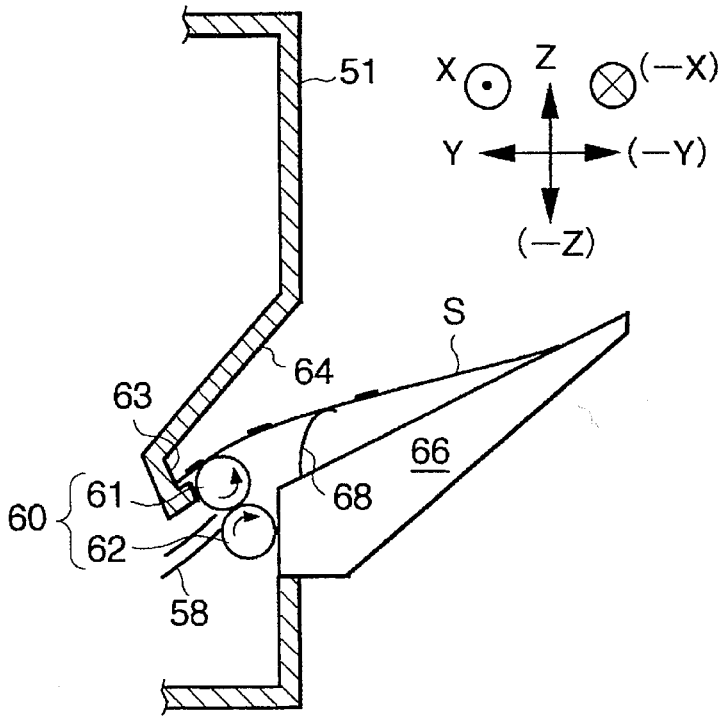
FIG. 23 explanatorily shows a condition that a first page of printed sheets has been discharged in a sheet discharger according to an embodiment 9 of the present invention.

Next, a sheet discharger U2 according to an embodiment 9 of the present invention will now be described with reference to FIG. 23. FIG. 23 is an explanatory diagram of this sheet discharger U2, namely the embodiment 9.

It should be understood in the following description of this embodiment 9 that the same reference numerals are employed as those for denoting the constructive elements corresponding to those of the embodiment 7, and no detailed descriptions thereof are made.

Although this embodiment 9 is different from the above-described embodiment 7 as to the below-mentioned points, other points are similar to those of the embodiment 7.

Although the sheet depressing member is constructed by the rotatable roller 67 in the embodiment 7, this sheet depressing member is constructed by a leaf spring 68 in the embodiment 9.

Similar to the embodiment 7, the rear end of the sheet S discharged to the rear surface supporting member 66 abuts against the sheet rear end supporting member 63 and is supported thereby.

[EMBODIMENT 10]

Figure 24:
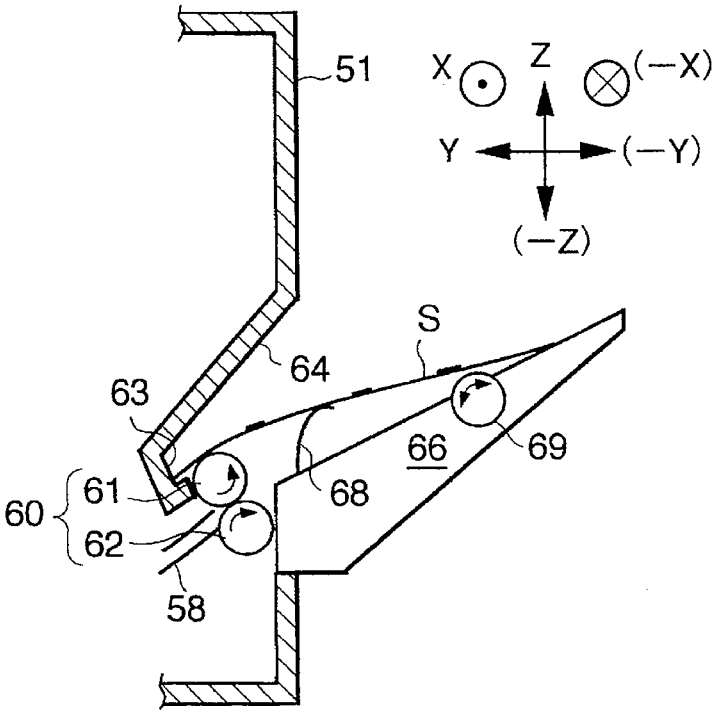
FIG. 24 explanatorily shows a condition that a first page of printed sheets has been discharged in a sheet discharger according to an embodiment 10 of the present invention.

Next, a sheet discharger U2 according to an embodiment 10 of the present invention will now be described with reference to FIG. 24. FIG. 24 is an explanatory diagram of this sheet discharger U2, namely the embodiment 10.

It should be understood in the following description of this embodiment 10 that the same reference numerals are employed as those for denoting the constructive elements corresponding to those of the embodiment 9, and no detailed descriptions thereof are made.

Although this embodiment 10 is different from the above-described embodiment 9 as to the below-mentioned points, other points are similar to those of the embodiment 9.

That is, a sheet transport roller 69 is employed at a central portion of an upper surface of the rear surface supporting member 66.

Further, the sheet transport roller is rotatably driven along the sheet discharge direction until the sheet S is discharged from the discharge roller apparatus 60, and, in turn, rotatably driven along opposite direction (namely, a direction along which the sheet is transported toward the sheet rear end supporting member 63) to the above-described sheet discharge direction after the sheet S has been discharged.

In this embodiment 10, similar to the above-explained embodiment 8, since the sheet transport roller 69 is driven, even when a total number of sheets S stacked on the rear surface supporting member 66 is increased, it is possible to discharge a new sheet under the stacked sheets.

While various embodiments of the present invention have been described in detailed, the present invention is not limited thereto, but may be modified within the featured scope of the present invention as defined in the accompanying claims. Various modified embodiments of the present invention will now be described.

That is, the present invention may be similarly applied to printers other than the laser writing type printer, e.g., ink jet printers, wire dot printers, and thermal transfer type printers. Further, the present invention may be applied to image recording apparatuses other than the printer, for instance, copying machines.

In the embodiment 4 shown in FIG. 10 and FIG. 11, the sheet depressing member (sheet rear end position control means) 43 constructed of the rotatable roller may be arranged by such a drive roller rotated by drive force, instead of this rotatable roller, and alternatively by employing a transport belt instead of this drive roller. Even in such a condition that a total number of discharged sheets is increased, and thus the sheet subsequently discharged is depressed against the rear surface supporting member 6 by the weights of the previously discharged sheets, the subsequent sheet may be easily discharged to the rear side of the previous sheet by employing such a drive roller, or such a transport belt. When such a drive roller, or a transport roller is employed, since the succeeding sheet would not be relatively influenced by the weights of the previously discharged sheets, it is possible to make the inclination of the rear surface supporting member 6 gentle. Also, either the rotatably driven roller, or the rotatably driven transport belt may be arranged on the upper portion of the rear surface supporting member.

Since a rib is formed on the rear surface supporting member 6 or 66 along the sheet discharge direction, it is possible to reduce the friction resistance of the sheet on the rear surface supporting member.

In the above-described embodiment 7, the sheet depressing member 67 is omitted. Instead of this sheet depressing member 67, a rear surface transport member similar to that of the embodiment 5, or 6 may be employed on the upper side discharge roller 61.

As previously described, the sheet discharger according to the present invention can have the following advantages. That is, in the sheet discharger with the simple structure, the subsequently discharged sheet can be stored under such a condition that the subsequently discharged sheet is overlapped on the rear surface of the previously discharged sheets.

What is claimed is:

1. A sheet discharger for an image recording apparatus comprising:

a sheet discharge tray positioned substantially vertically relative to the image recording apparatus, said sheet discharge tray having a rear surface supporting member for supporting a rear Surface of a discharged sheet, a bottom member for supporting a lower end of the discharged sheet, and a front surface supporting member for defining a forward position of the lower end of the discharged sheet;

a discharge roller apparatus positioned adjacent to the bottom member, said discharging roller apparatus having a front side discharge roller and a rear side discharge roller positioned at a lower end portion of said sheet discharge tray; and a sheet rear end position control means for positioning a rear end of the discharged sheet to said sheet discharge tray over said bottom member.

2. A sheet discharger as claimed in claim 1 wherein:

said sheet rear end position control means is arranged by a means for causing a tip portion of a sheet discharged from said discharge roller apparatus to abut against said front surface supporting member; and said front surface supporting member is so arranged as to guide said abutting tip portion of the sheet along an upper, rearward direction.

3. A sheet discharger as claimed in claim 2, wherein the means for causing the tip portion of the sheet to abut against the front surface is so constructed by arranging the front side discharge roller and a rear side discharge roller, which are positioned to direct the tip portion of the discharged sheet to the front surface supporting member.

4. A sheet discharger as claimed in claim 3, wherein both of the front side discharge roller and the rear side discharge roller are arranged in such a way that the rear side discharge roller is positioned backwardly and upwardly from the front side discharge roller.

5. A sheet discharger as claimed in claim 1 wherein:

said sheet rear end position control means is activated by a sheet depressing member positioned at a lower portion of said rear surface supporting member.

6. A sheet discharger as claimed in claim 1 wherein:

said sheet rear end position control means is arranged by a rear end transport member which is rotated around a shaft of said front side discharge roller, and which transports a rear end of the discharged sheet over said bottom member.

7. A sheet discharger for discharging a printed sheet having a first surface on which an image is formed and a second surface opposite said first surface, and receiving the printed sheet thus discharged therein, said sheet discharger comprising:

a tray including:

a first supporting member located to face said second surface of the printed sheet thus discharged for contacting and supporting said second surface of the printed sheet thus discharged, said first supporting member including a rotatable sheet depressing member; and a second supporting member for receiving and supporting a trailing edge of the printed sheet thus discharged, a discharge roller device located between said first and second supporting members for discharging the printed sheet to said tray so that said second surface faces said first supporting member, said discharge roller device including:

a first roller located proximate said first supporting member; and a second roller juxtaposed with said first roller and located proximate said second supporting member for discharging the printed sheet in cooperation with said first roller, and guiding toward said second supporting member the printed sheet thus discharged so that the trailing edge of said printed sheet thus discharged contacts said second supporting member.

8. A sheet discharger according to claim 7 wherein after a first printed sheet is discharged to said tray, said discharge roller device discharges a second, subsequent printed sheet into a space defined between said first supporting member and said second surface of the first printed sheet.

9. A sheet discharger according to claim 8, wherein said first supporting member extends obliquely upward and away from said first and second rollers.

* * * * *